US006429591B1

(12) United States Patent
Takamatsu et al.

(10) Patent No.: US 6,429,591 B1
(45) Date of Patent: Aug. 6, 2002

(54) LAMP SOCKET AND DISCHARGE LAMP OPERATING DEVICE

(75) Inventors: Kenichi Takamatsu, Niigata; Takaaki Chuzawa, Osaka; Takao Miyai; Kazuhiko Kinutani, both of Niigata, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/830,402

(22) PCT Filed: Oct. 2, 2000

(86) PCT No.: PCT/JP00/06844

§ 371 (c)(1),
(2), (4) Date: Apr. 27, 2001

(87) PCT Pub. No.: WO01/24323

PCT Pub. Date: Apr. 5, 2001

(30) Foreign Application Priority Data

Sep. 30, 1999 (JP) ..... 11-280154
Sep. 30, 1999 (JP) ..... 11-280156

(51) Int. Cl.[7] ..... H01J 7/44
(52) U.S. Cl. ..... 315/56; 315/57; 362/265
(58) Field of Search ..... 315/56, 57, 58; 362/260, 265

(56) References Cited

U.S. PATENT DOCUMENTS 4,258,287 A * 3/1981 Hetzel ..... 315/58
5,959,407 A 9/1999 Ito et al.
6,049,163 A 4/2000 Masuda et al.
6,049,659 A 4/2000 Matsumoto et al.
6,084,354 A 7/2000 Kohmura et al.

FOREIGN PATENT DOCUMENTS

JP 08-130127 5/1996

* cited by examiner

*Primary Examiner*—David Vu
(74) *Attorney, Agent, or Firm*—Burns, Doane, Swecker & Mathis, LLP

(57) ABSTRACT

A lamp socket and a discharge lamp lighting device are enabled to be dimensionally minimized by forming a socket body of the lamp socket with an integral synthetic resin molding of a case housing therein a starting circuit section and socket and connector sections, disposing a plurality of lead frames in the case, connecting the lead frames to primary and secondary windings of a pulse transformer, thereafter housing in the case electronic parts with their terminals placed in recessed grooves of the lead frames, and connecting the lead frames and terminals to constitute the starting circuit section.

13 Claims, 18 Drawing Sheets

16c
16b
16a
13a
13a
13

16c
16b
16a
13a
13a
13a
13a
13a
13a
13a
13a
13a
13b
13b
13b 19
13b
17
13a
13a
18
13a
13a
13a

LAMP SOCKET AND DISCHARGE LAMP OPERATING DEVICE

TECHNICAL FIELD

This invention relates to a lamp socket for detachably mounting thereto a discharge lamp and to a discharge lamp lighting device incorporating the lamp socket.

BACKGROUND OF THE INVENTION

In respect of automotive head lamps in recent years, there has been a tendency that discharge lamps of higher brightness, lower power consumption and longer life than conventional halide lamps have been employed, attaching importance to the safety. Such discharge lamps employed in the automotive head lamps have involved a problem that, because of the necessity of applying such very high voltage as to be more than 13 kV upon starting, a starting circuit for applying the high starting voltage and a lamp socket for mounting the discharge lamp are arranged as separate members so that parts number is increased and occupying space in the automobile is enlarged.

In view of this, there have been suggested various attempts in Japanese Patent Laid-Open Publications Nos. 10-214733, 11-7807, 10-223005, 10-255507 and so on for reducing the parts number and occupying space by housing at least part of the starting circuit in a socket body of the lamp socket.

SUMMARY OF THE INVENTION

In the foregoing prior art, however, there has been a problem that, as the starting circuit has been constituted by mounting electronic parts on printed circuit substrate, they have been able to be disposed only in two dimensional manner in the socket body, there has occurred a dead space in upper space of the respective electronic parts, and eventually the lamp socket as well as the discharge lamp lighting device employing the lamp socket have had to be dimensionally enlarged.

The present invention has been suggested for overcoming the foregoing problem, and its object is to establish a dimensional minimization of the lamp socket and discharge lamp lighting device.

The present invention establishes the above object by means of one comprising a socket section to which a discharge lamp is dismountably mounted, a connector section for electrical connection with the exterior, a starting circuit section including a plurality of electronic parts and lead frames connected to at least part of these electronic parts for forming wiring paths between the respective electronic parts to start the discharge lamp with a high voltage applied thereto, and a case in which the starting circuit section is provided, characterized in that the socket and connector sections are integrally provided.

Other objects and advantages of the present invention shall be understood from following description made with reference to drawings.

Figure 1:
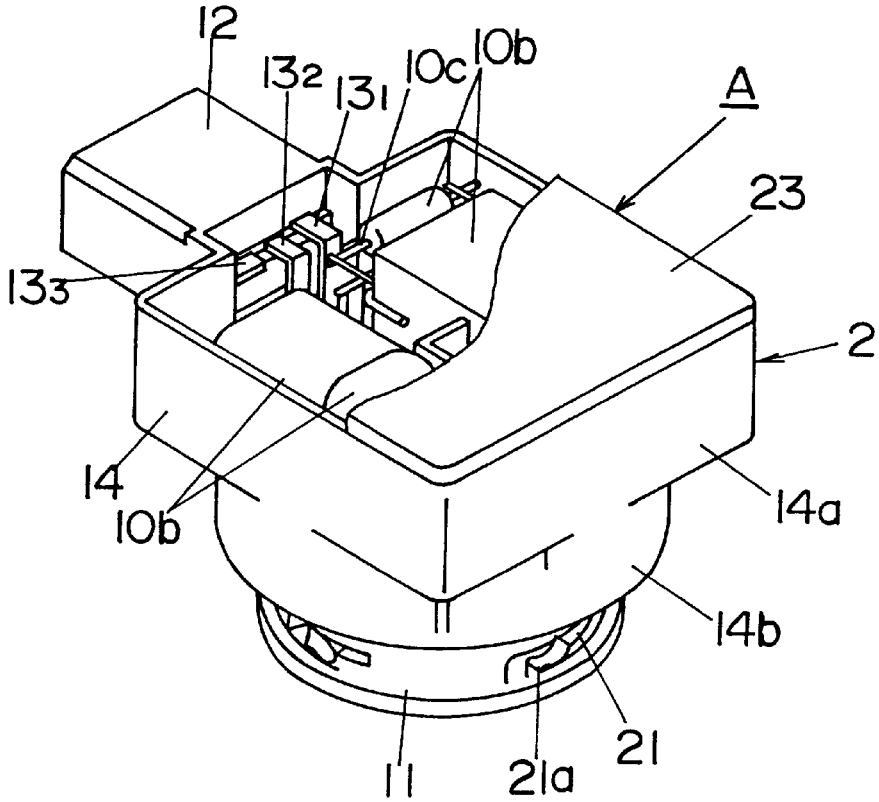
FIG. 1 is a perspective view in an embodiment of the lamp socket according to the present invention.
Figure 5:
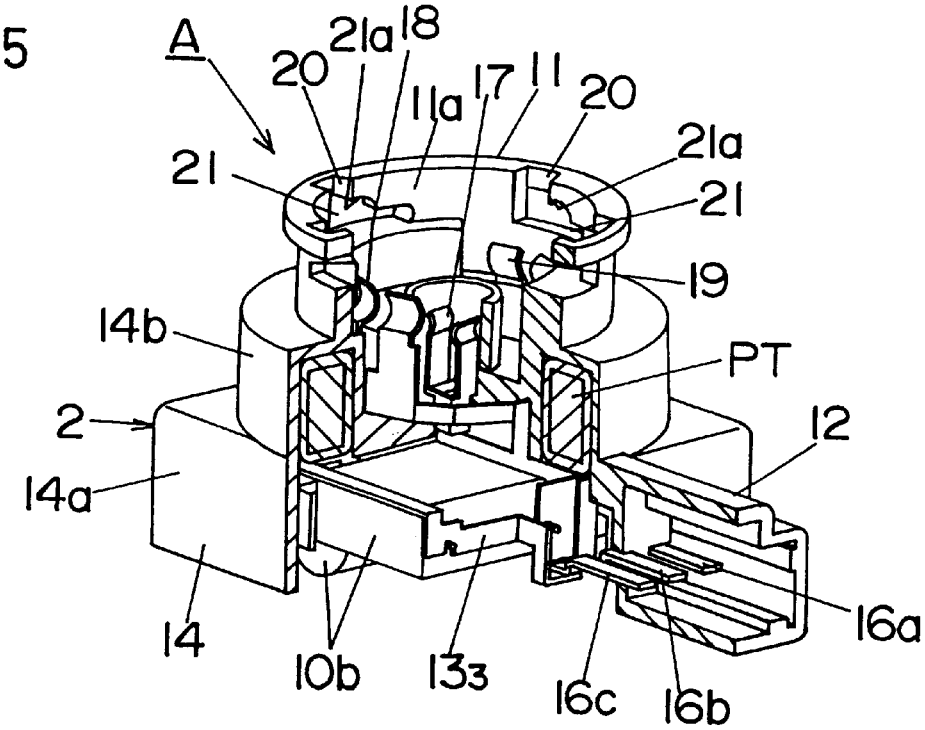
FIG. 5 is a perspective view of the lamp socket of FIG. 1 with part shown as removed.
Figure 2:
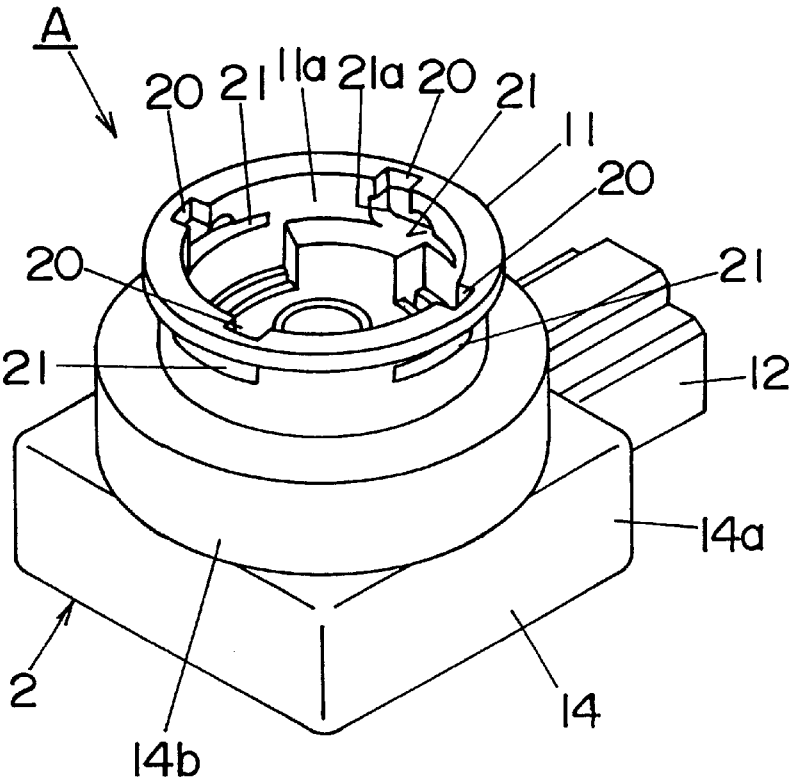
FIG. 2 is a perspective view as viewed in another angle of the embodiment of FIG. 1.
Figure 3:
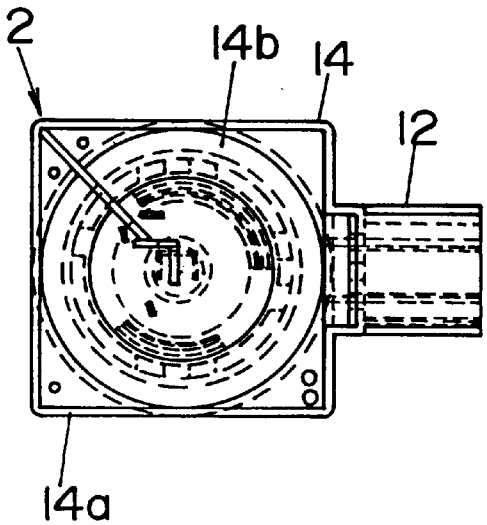
FIG. 3 is a bottom view of the lamp socket in FIG. 1.
Figure 4:
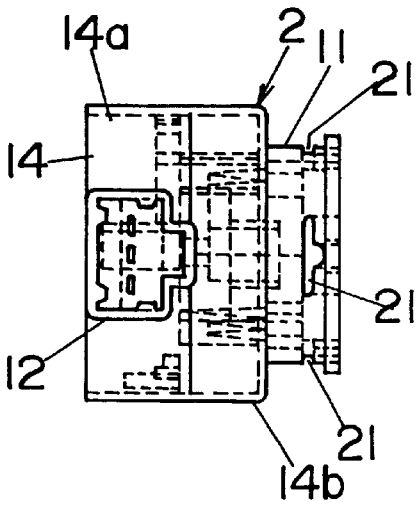
FIG. 4 is a side view of the lamp socket in FIG. 1.
Figure 6:
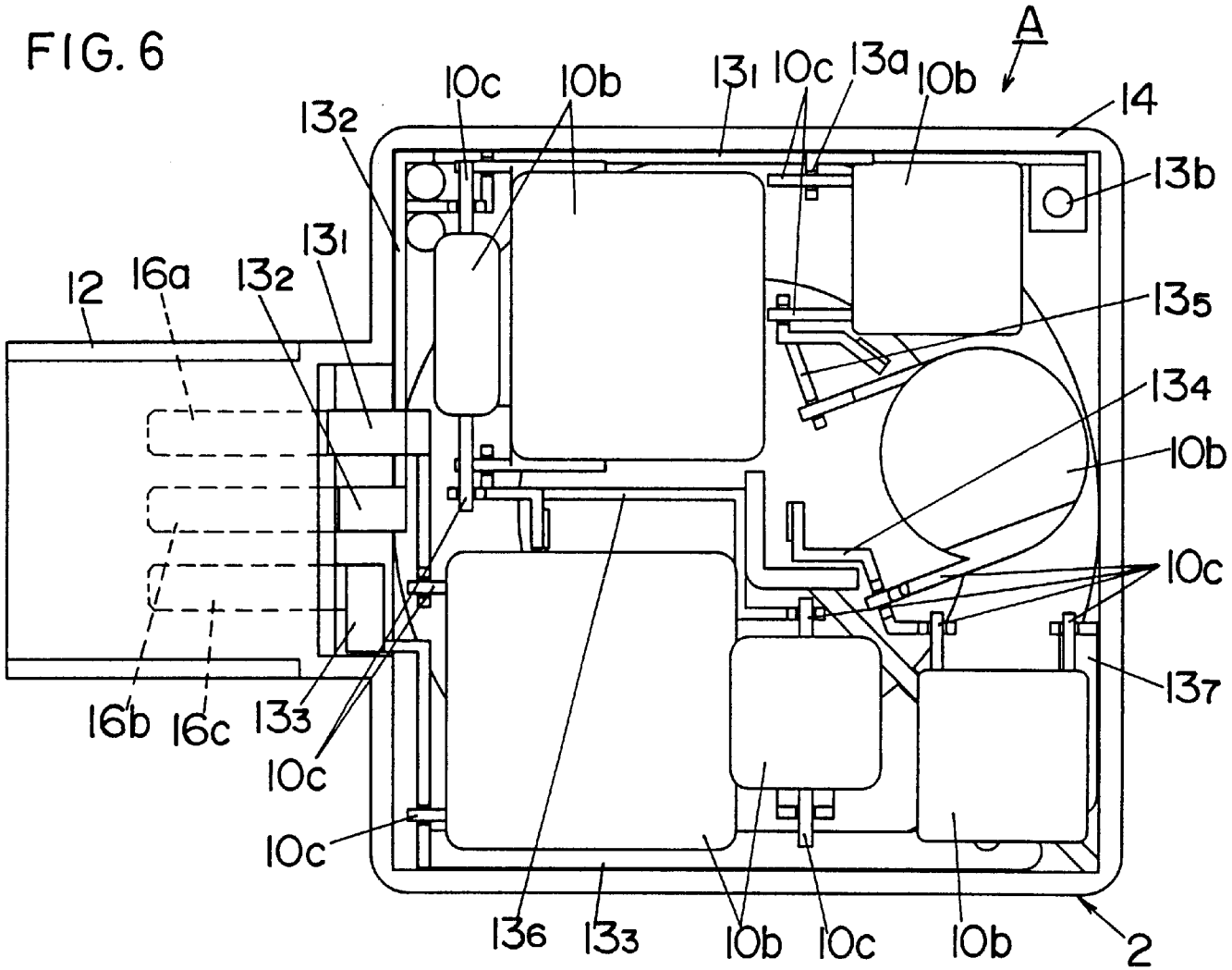
FIG. 6 is a bottom view of the lamp socket of FIG. 1 in a state where a lid is removed.
Figure 7:
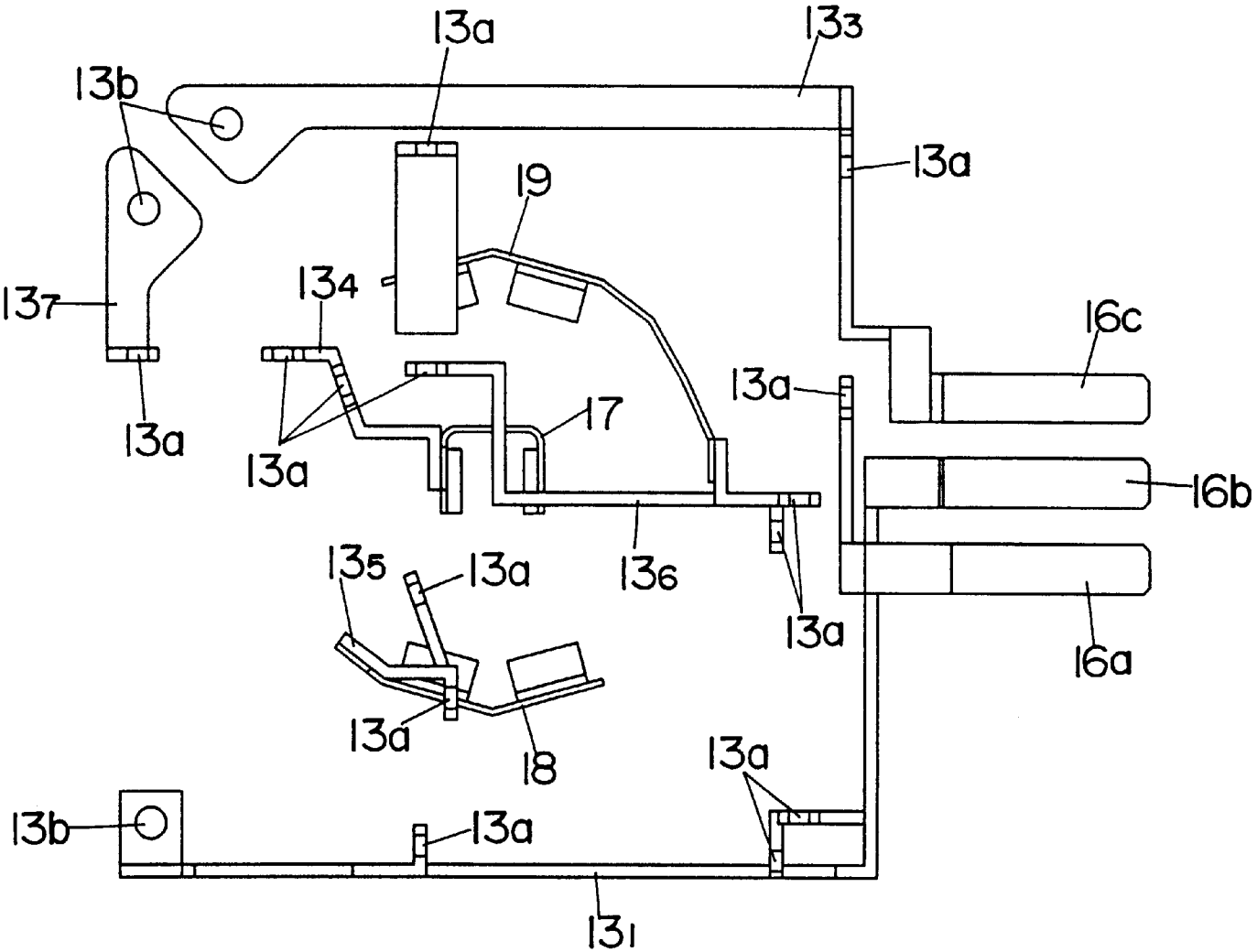
FIG. 7 is an explanatory view for the lamp socket of FIG. 1.
Figure 8:
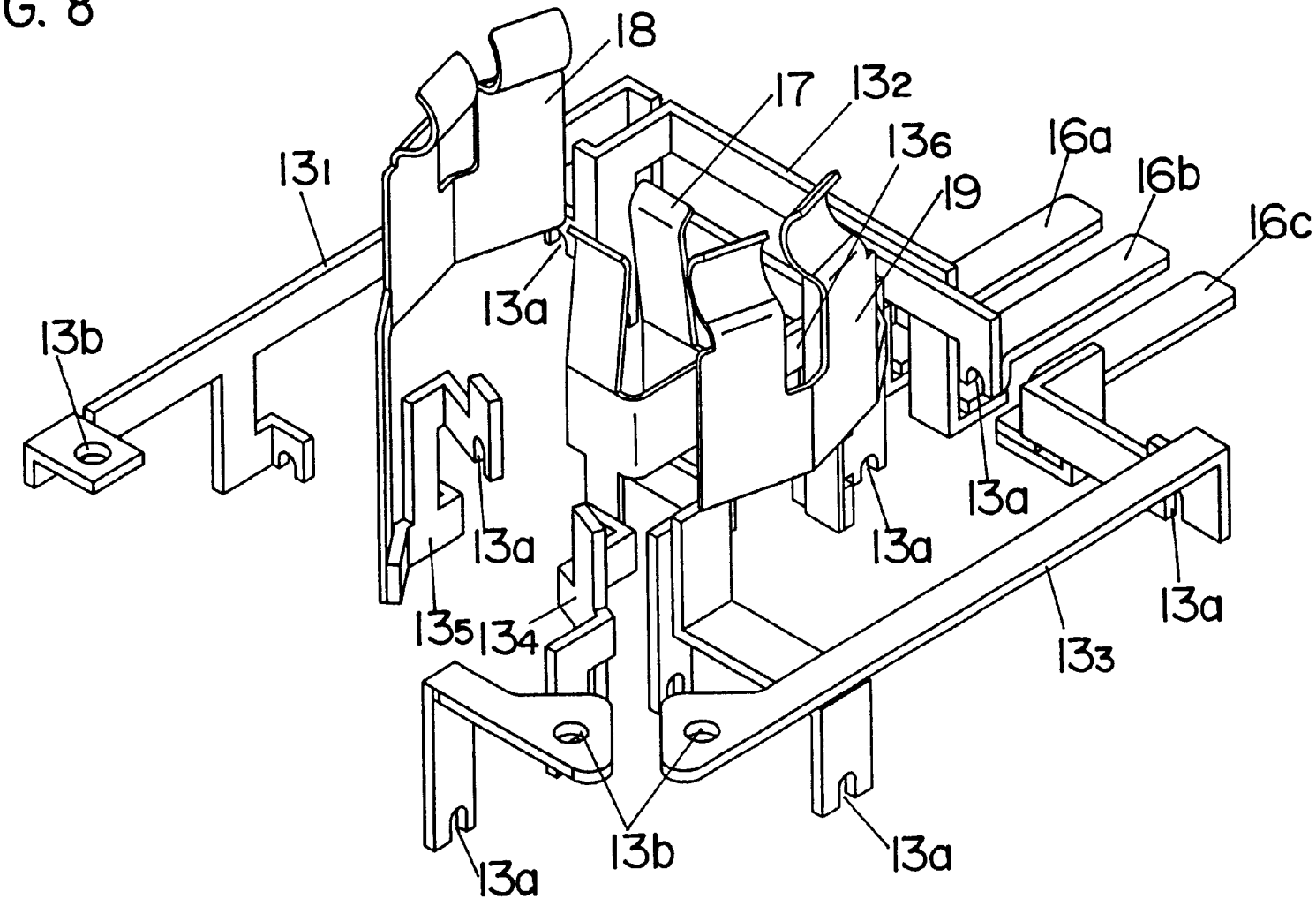
FIG. 8 is an explanatory view for the lamp socket of FIG. 1.
Figure 9:
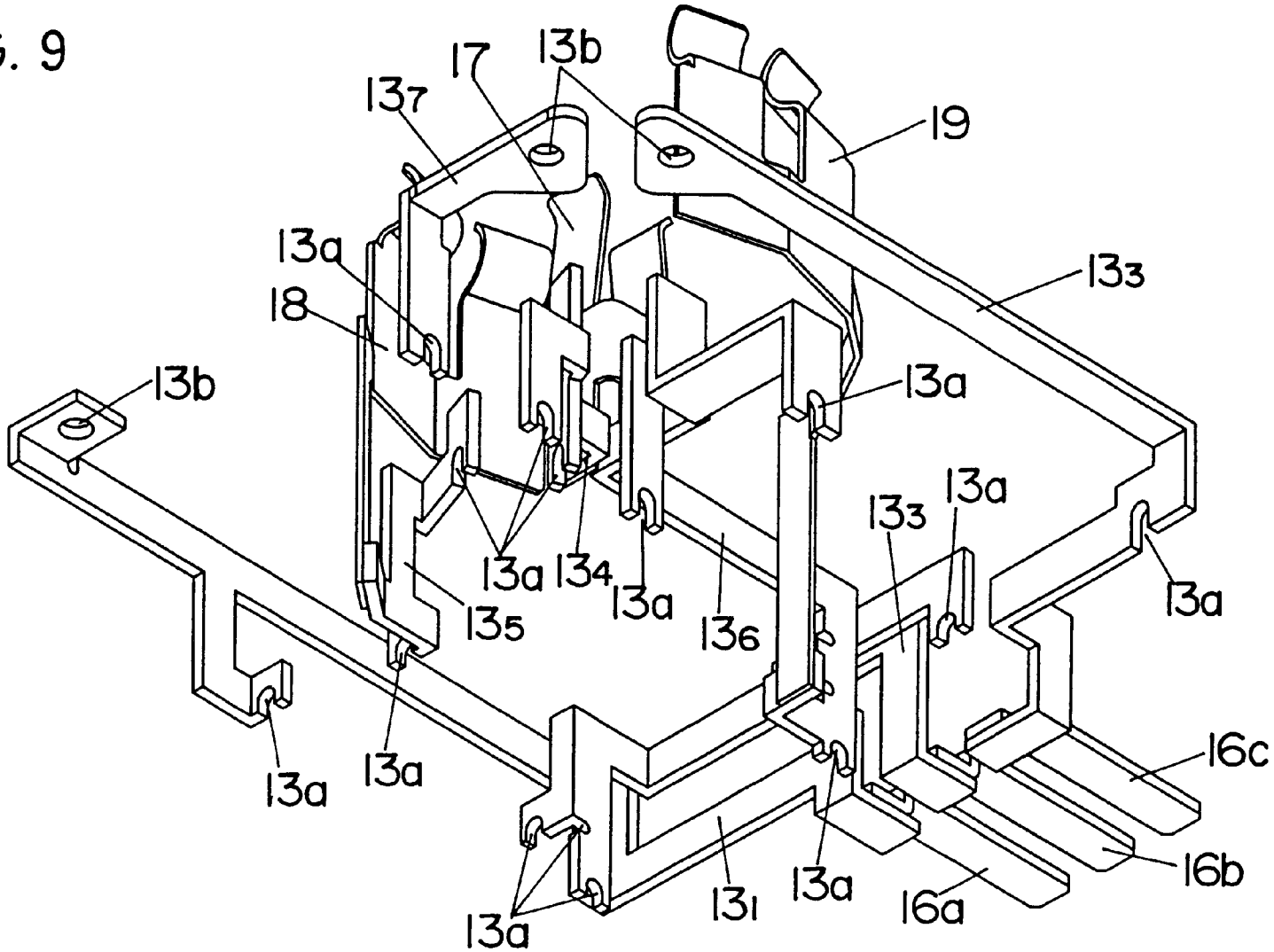
FIG. 9 is an explanatory view for the lamp socket of FIG. 1.
Figure 10:
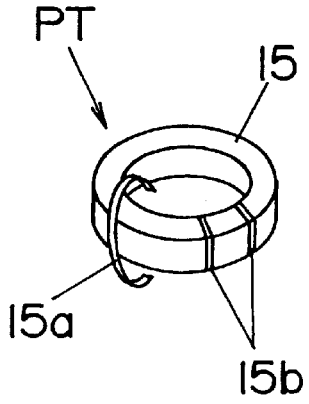
FIG. 10 is a perspective view of a pulse transformer in the lamp socket of FIG. 1.
Figure 15:
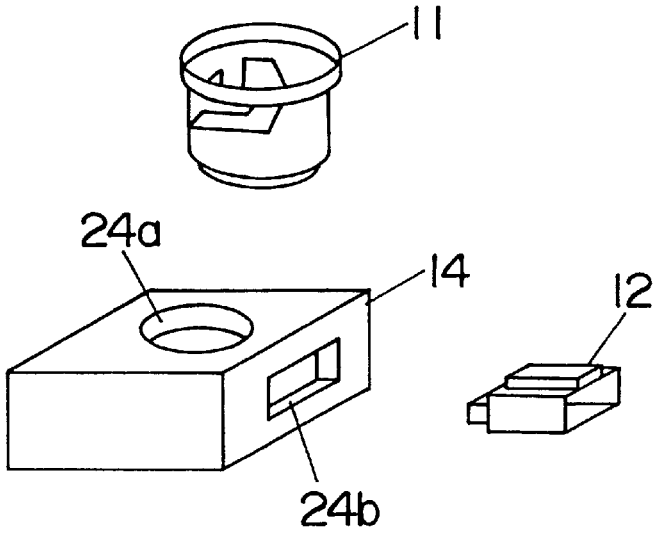
FIG. 15 is a perspective view as disassembled of another embodiment of the present invention.

While the present invention shall now be described with reference to the embodiments shown in the accompanying drawings, it should be appreciated that the intention is not to limit the invention only to these embodiments but rather to include all alterations, modifications and equivalent arrangements possible within the scope of appended claims.

THE BEST MODE FOR CARRYING OUT THE INVENTION

With reference to FIGS. 1 to 10, there is shown an embodiment in which the present invention is applied to an automotive head lamp device (discharge lamp lighting device). This embodiment comprises a lighting circuit section 1 for supplying a power to a discharge lamp AL as the head lamp with a source power supplied from such DC source E as an automobile battery or the like, and a lamp socket A including a starting circuit section 10 generating a high voltage for starting the discharge lamp A, a socket section 11 to which the discharge lamp LA is dismountably mounted, and a connector section 12 for electrically connecting the lighting circuit section 1 and the starting circuit section 10. The lighting circuit section 1 and discharge lamp LA are connected through the connector section 12 connected to the starting circuit section 10. That is, the connector section 12 and socket section 11 are electrically connected in the interior of the lamp socket A and the lighting circuit section 1 is electrically connected through the lamp socket A to the discharge lamp LA. As the lighting circuit section 1, for example, one which boosts the DC source E with a DC-DC converter (not shown) employed and then converts it to an alternating power of a relatively low frequency (below several hundred Hz) with an inverter (not shown) employed may be used. Here, the inverter supplies the alternating power to the discharge lamp LA in order to avoid an acoustic resonating phenomenon in the discharge lamp LA. Operation of the DC-DC converter and inverter is controlled by a control circuit (not shown). The starting circuit section 10 is connected to this lighting circuit section 1 so that, when a switch SW inserted between the DC power source E and the lighting circuit section 1 is made ON, a starting voltage of the high voltage is applied from the starting circuit section 10 to the discharge lamp LA, and then an output of the inverter is supplied to the discharge lamp LA.

Further, the starting circuit section 10 is of a well known arrangement comprising, for example, such electronic parts 10*b* as, for example, a discharge gap or a capacitor, inductor, resistor and the like, and is provided with a main circuit 10*a* for generating a high voltage pulse from an output of the lighting circuit section 1, and with a pulse transformer PT which applies to the discharge lamp LA a pulse of further higher voltage as occurred at a secondary winding 15*b* as a result of an input of the high voltage pulse of the main circuit 10*a* to a primary winding 15*a*. In the present embodiment, as will be described later, the starting circuit section 10 is constituted without employing any printed circuit substrate but by forming wiring paths between the respective electronic parts 10*b* including the pulse transformer PT with a plurality of lead frames 13 connecting such electronic parts 10*b* as the discharge gap or capacitor as well as the pulse transformer PT and so on.

Figure 12:
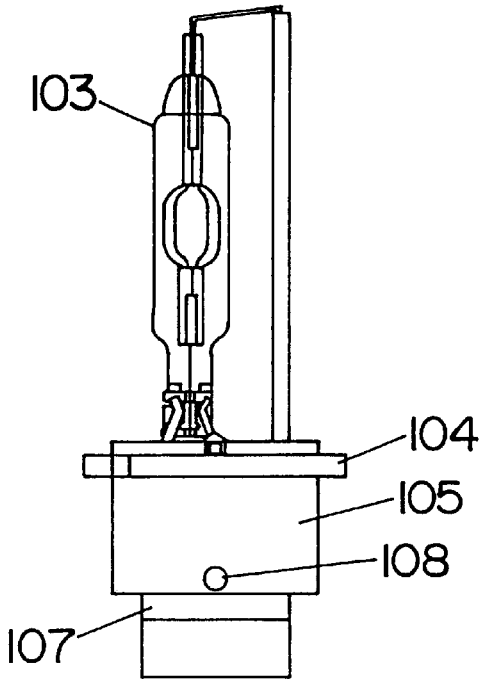
FIG. 12 is a side view of the discharge lamp of FIG. 11.
Figure 13:
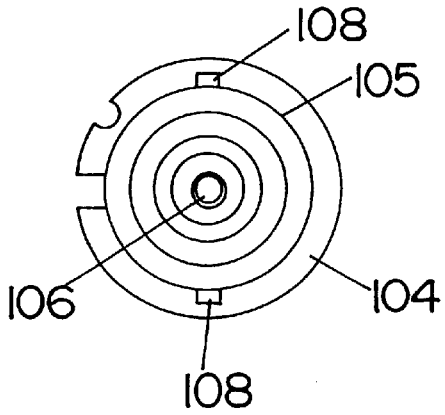
FIG. 13 is a bottom view of the discharge lamp of FIG. 11.

On the other hand, the discharge lamp LA comprises an HID (high intensity discharge) lamp of such well known structure comprising, as shown in FIGS. 12 and 13, a light emitting tube 103, a lamp base 105 having a flange 104, a center electrode 106, an outer peripheral electrode 107 and a pair of engaging projections 108 projected out of the periphery of the lamp base 105.

In the lamp socket A, a socket body 2 is formed by integrally molding with a synthetic resin a case 14 for mounting therein the starting circuit section 10 as well as the socket and connector sections 11 and 12. The case 14 has a main circuit housing part 14*a* of a rectangular box shape opened on one surface and a transformer housing part 14*b* substantially of a cylindrical shape provided to project outward from the other surface opposite to the opened surface. In the main circuit housing part 14*a*, other electronic parts 10*b* than the pulse transformer PT as well as the main circuit 10*a* comprising a plurality of the lead frames 13 are housed, while in the transformer housing part 14*b* the pulse transformer PT in which the primary and secondary windings 15*a* and 15*b* are wound on a ring-shaped core 15 are wound is housed.

The connector section 12 is provided substantially in a rectangular cylinder projecting outward from one side face of the main circuit housing part 14*a* of the case 14. Here, three input terminals 16*a*, 16*b* and 16*c* respectively connected to end portions of different lead frames 131–133 are fixed to the side face of the case 14 so as to conform their longitudinal direction to axial direction of the connector section 12 and to project inside the connector section 12.

The socket section 11 is of a cylindrical, bottomed tubular shape, having at one end a lamp mounting opening 11*a* and projecting outward from a bottom face of the transformer housing part 14*b* of the case 14. The socket section 11 has, as main electrodes, a center electrode 17 contacting with the center electrode 106 of the lamp base 105 of the discharge lamp LA and an outer peripheral electrode 18 contacting with the outer peripheral electrode 107 of the lamp base 105 of the discharge lamp LA, and is further provided with an auxiliary electrode 19 of the same construction as the outer peripheral electrode 18 at a position opposing the outer peripheral electrode 18 with the center electrode 17 interposed between them. These auxiliary electrode 19 and outer peripheral electrode 18 are so provided as to be mutually connected by means of the outer peripheral electrode 107 of the lamp base 105, when the lamp base 105 of the discharge lamp LA is inserted. On the periphery of the socket section 11, further, there are provided inserting grooves 20 for inserting the engaging projections 108 projected from the periphery of the lamp base 105 and engaging grooves 21 communicating with the inserting grooves 20. At a side end face of the lamp mounting opening 11*a* at positions where the engaging grooves 21 communicates with the inserting grooves 20, angle projections 21*a* are provided.

Now, as the lamp base 105 of the discharge lamp LA is inserted in the lamp inserting opening 11*a* of the socket section 11 with the engaging projections 108 inserted in the inserting grooves 20 and the discharge lamp LA is rotated with respect to the lamp socket A, the engaging projections 108 are brought, over the projections 21*a*, into engagement in the engaging grooves 21 communicating with the inserting grooves 20, upon which the center electrode 106 of the discharge lamp LA comes into conductive contact with the center electrode 17 of the lamp socket A, and the outer peripheral electrode 107 of the discharge lamp LA is contacted conductively, so as to be able to supply power to the discharge lamp LA.

Figure 14:
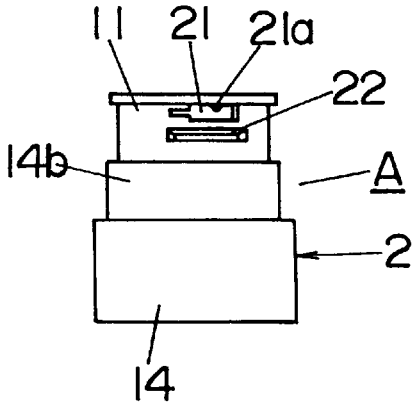
FIG. 14 is a side view of the lamp socket in another embodiment of the present invention.

While the foregoing mounting structure as has been described of the discharge lamp LA and lamp socket A has been well known (see, for example, Japanese Patent Laid-Open Publication No. 10-69953), it has been difficult to attain a feeling of click at the time when the engaging projections 108 of the discharge lamp LA pass over the projections 21*a* of the engaging grooves 21, and there has been a risk that the mounting is held in an incomplete state. Accordingly, as shown in FIG. 14, a slit 22 is provided in the peripheral part of the socket section 11 to be in parallel with the engaging groove 21, so as to render edge surface of the engaging grooves 21 opposing the slit 22 to be easily bendable, so that the arrangement may be made to allow the feeling of click to be attained upon passing of the engaging projection 108 over the projection 21*a*, whereby it is enabled to prevent the discharge lamp LA from being mounted in incomplete state with respect to the socket section 11.

Next, structure of the starting circuit section 10 which is an essential point of the present invention shall be further detailed. As shown in particular in FIGS. 6–9, the lead frames 13 are formed in a strap shape, and are provided respectively at important points with recessed grooves 13*a* for mounting and connecting terminals (leads) of the electronic parts 10*b* or inserting holes 13*b* for inserting and connecting terminals of the windings of the pulse transformer PT. Adjacent to peripheral edge of the case 14, three of the lead frames 131–133 are disposed, and the input terminals 16*a*–16*c* are connected respectively to one end of these lead frames 131–133 with such proper means as laser welding, spot welding, resistance welding, soldering or the like. Further, in the central part of the interior of the case 14, a lead frame 134connected to the center electrode 17 is disposed, and, around it, lead frames 135and 136connected respectively at their one end to the outer peripheral electrode 18 and auxiliary electrode 19 are disposed.

Then, the pulse transformer PT is housed within the transformer housing part 14*b* of the case 14, the plurality of lead frames 131 . . . are housed from above and disposed in the case 14, the lead frames 131 . . . are connected to the primary and secondary windings 15*a* and 15*b*, thereafter the electronic parts 10*b* are housed within the case 14 so as to dispose the terminals 10*c* in the recessed grooves 13*a* of the lead frames 131 . . . , and the lead frames 131 . . . and terminals 10*c* are connected through such proper means as the laser welding, spot welding, resistance welding, soldering or the like, whereby the starting circuit section 10 can be formed. Further, the interior of the socket body 2 is filled with a resin, the opening of the case is closed with a flat-plate shaped lid 23, and the lamp socket A is completed.

While the starting circuit has been constituted conventionally by mounting the electronic parts to the printed circuit substrate, therefore, the electronic parts 10*b* of the starting circuit section 10 are electrically connected by the lead frames 131 . . . in the present invention, so that the printed circuit substrate is not required to be used, the case 14 for housing the starting circuit section 10 and eventually the socket body 2 can be reduced in the volume, and the dimensional minimization is made possible. Further, while in the present embodiment the lead frames 131 . . . , input terminals 16*a*–16*c* and output terminals (center, outer peripheral and auxiliary electrodes 17–19) are constituted as separate parts, it is also possible to constitute them integrally by means of a press molding, to simultaneously mold them with the socket body 2 (insert molding), or to press-fit the lead frames 131 . . . to the socket body 2.

While in the present embodiment the socket body 2 is constituted by forming integrally the socket section 11, connector section 12 and case 14 with the synthetic resin, further, it may be also possible to constitute the socket body 2 by, as shown in FIG. 13, forming them respectively as separate parts and fitting respective fitting parts of the socket section 11 and connector section 12 to fitting holes 24*a* and 24*b* of the case 14. In this case, it is desirable to weld the fitting parts of the case 14, socket section 11 and connector section 12 by means of vibration welding or ultrasonic welding. That is, the fitting only of the fitting parts of the socket section 11 and connector section 12 to the fitting holes 24*a* and 24*b* of the case 14 involves a risk that the high voltage generated at the starting circuit section 10 leaks through a gap at the fitting parts to deteriorate the insulation properties, but the fitting parts can be fixed without any gap by welding the fitting parts as in the above by means of the vibration welding or ultrasonic welding, and the insulation properties with respect to the high voltage yielded at the starting circuit section 10 can be also secured. Further, it is possible to prevent from occurring such inexpedience that the fitting parts are damaged due to vibration during running when the device is loaded on the automobile.

Figure 16:
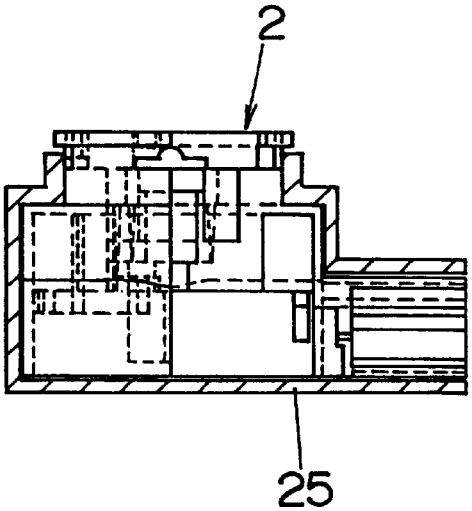
FIG. 16 is a side view of another embodiment of the present invention.
Figure 11:
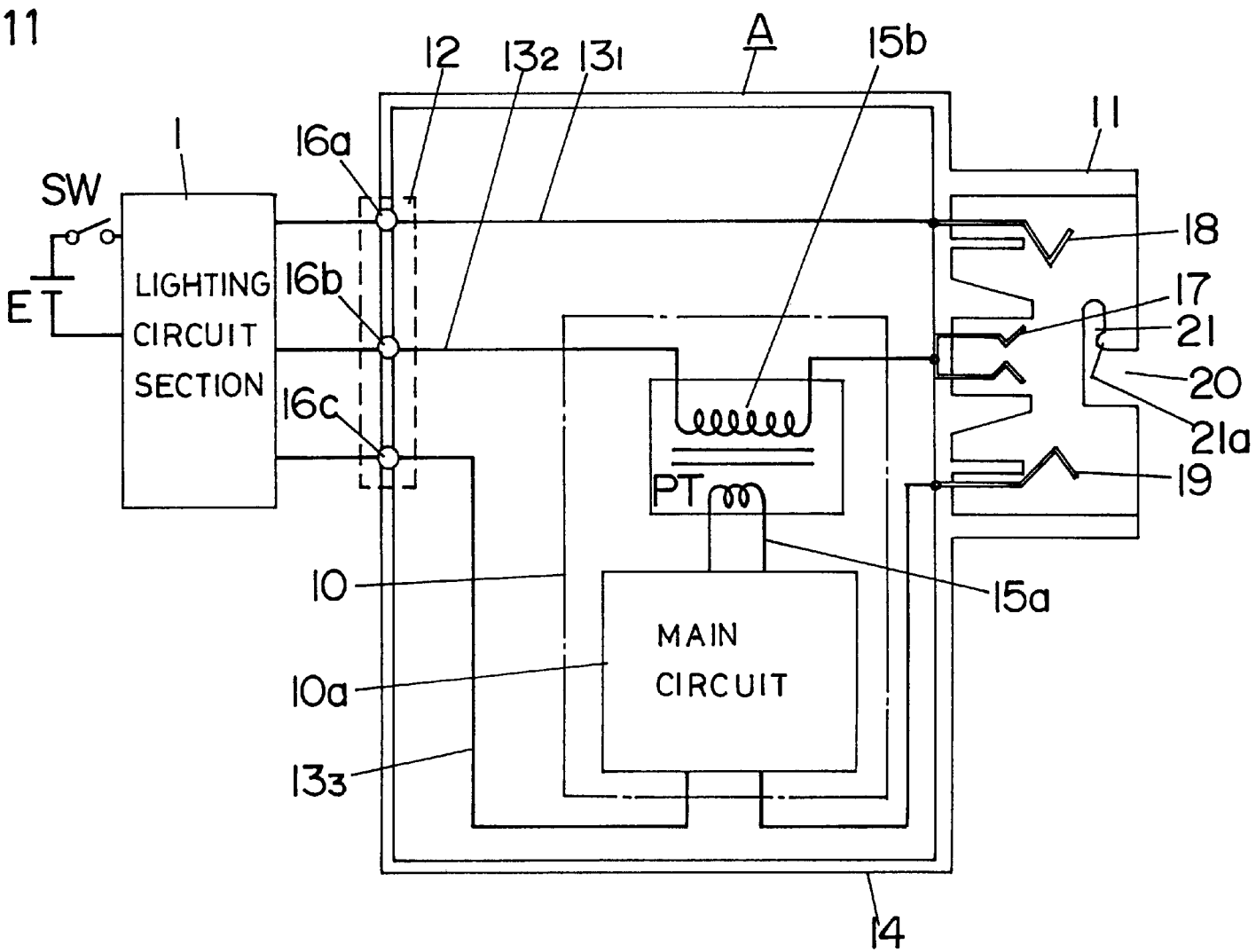
FIG. 11 is a block diagram showing a discharge lamp lighting device employing the present embodiment.

Further, when a conductive member 25 which covers substantially the entirety of the socket body 2 is provided through a forming of a conductive resin, as shown in FIG. 16, the socket body is shielded by this conductive member 25 so that any noise radiated from the starting circuit section 10 and discharge lamp LA accompanying the high voltage can be reduced.

Figure 17:
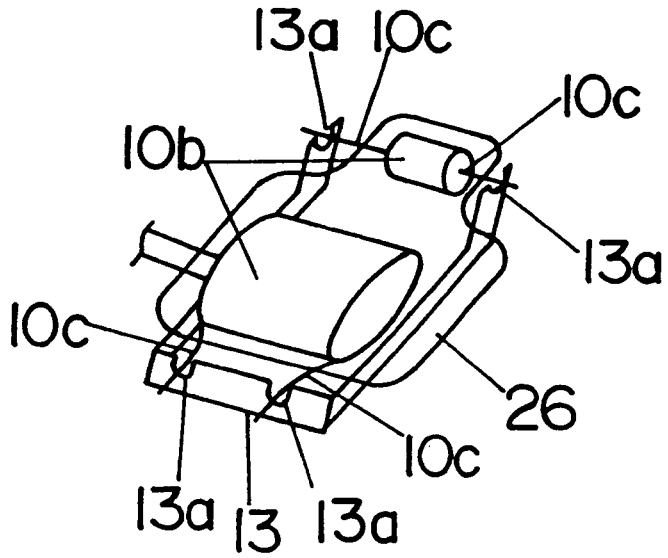
FIG. 17 is a perspective view of another embodiment of the present invention.

While according to the present embodiment the terminals 10*c* of the electronic parts 10*b* and lead frames 131 . . . are connected after housing the electronic parts in the case 14 and the opaque synthetic resin is filled in the case 14 to seal it, on the other hand, it is also possible to seal and fix the electronic parts 10*b* and lead frames 131 . . . with a light transmitting resin 26 except their connecting portions, as shown in FIG. 17. With this arrangement, it is made advantageous in that the connecting work of the terminals 10*c* of the electronic parts 10*b* to the lead frames 131 . . . is rendered easier, the presence of the electronic parts 10*b* can be confirmed even after their sealing with the resin 26, and absence or any abnormality of the electronic parts 10*b* can be easily confirmed. In addition, it is made also possible to improve the workability by the fixing with the light transmitting resin 26 as in the above, even when the electronic parts 10*b* and lead frames 131 . . . prior to their housing into the case 14.

Figure 18:
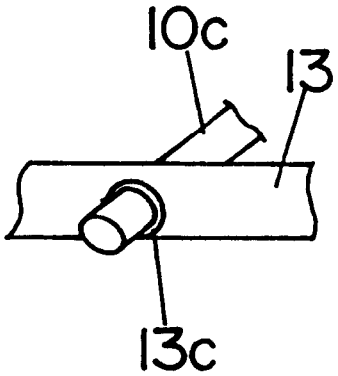
FIGS. 18 and 19 are respectively explanatory views for another embodiment of the present invention.
Figure 19:
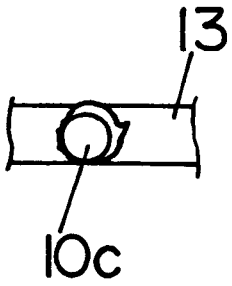
Figure 20:
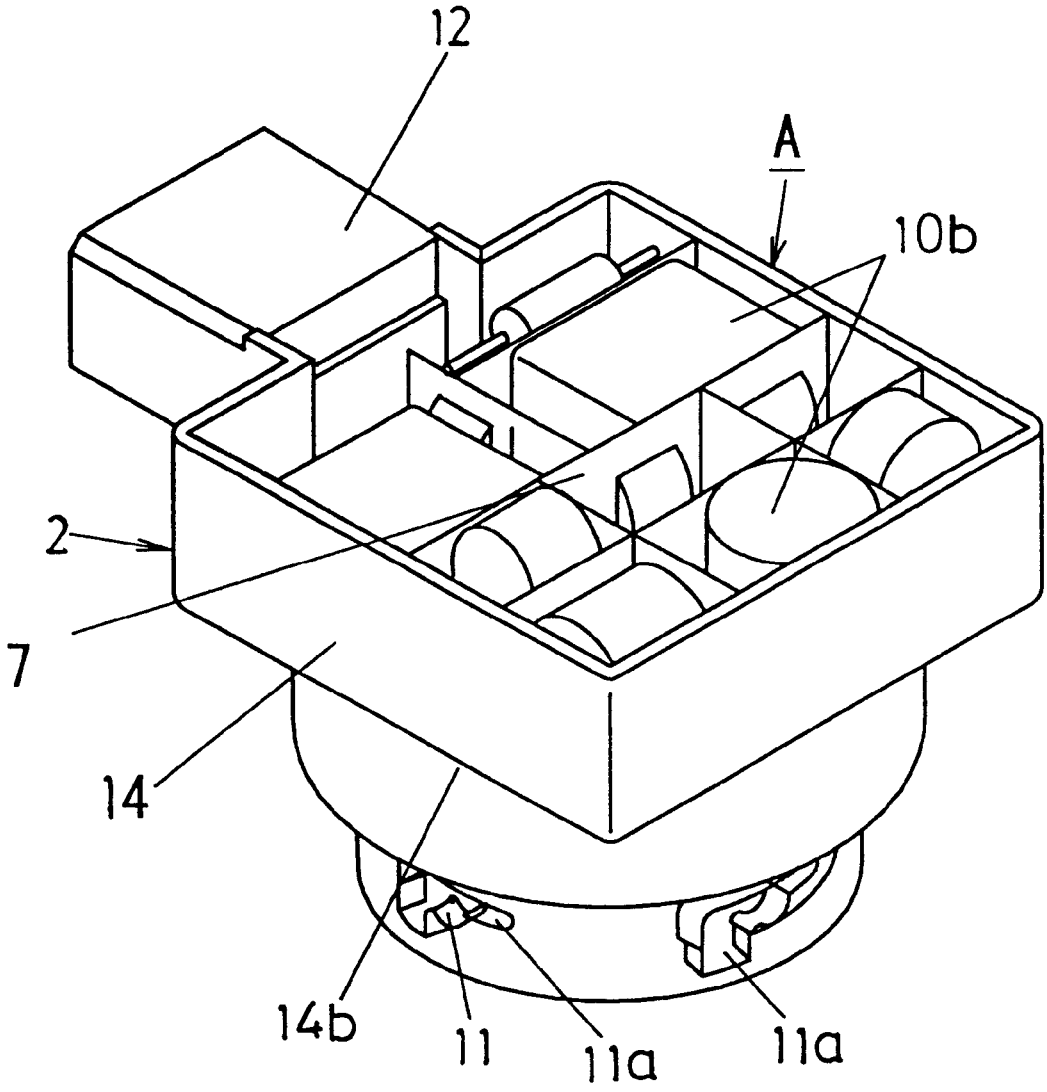
FIG. 20 is a perspective view of another embodiment of the present invention.
Figure 21:
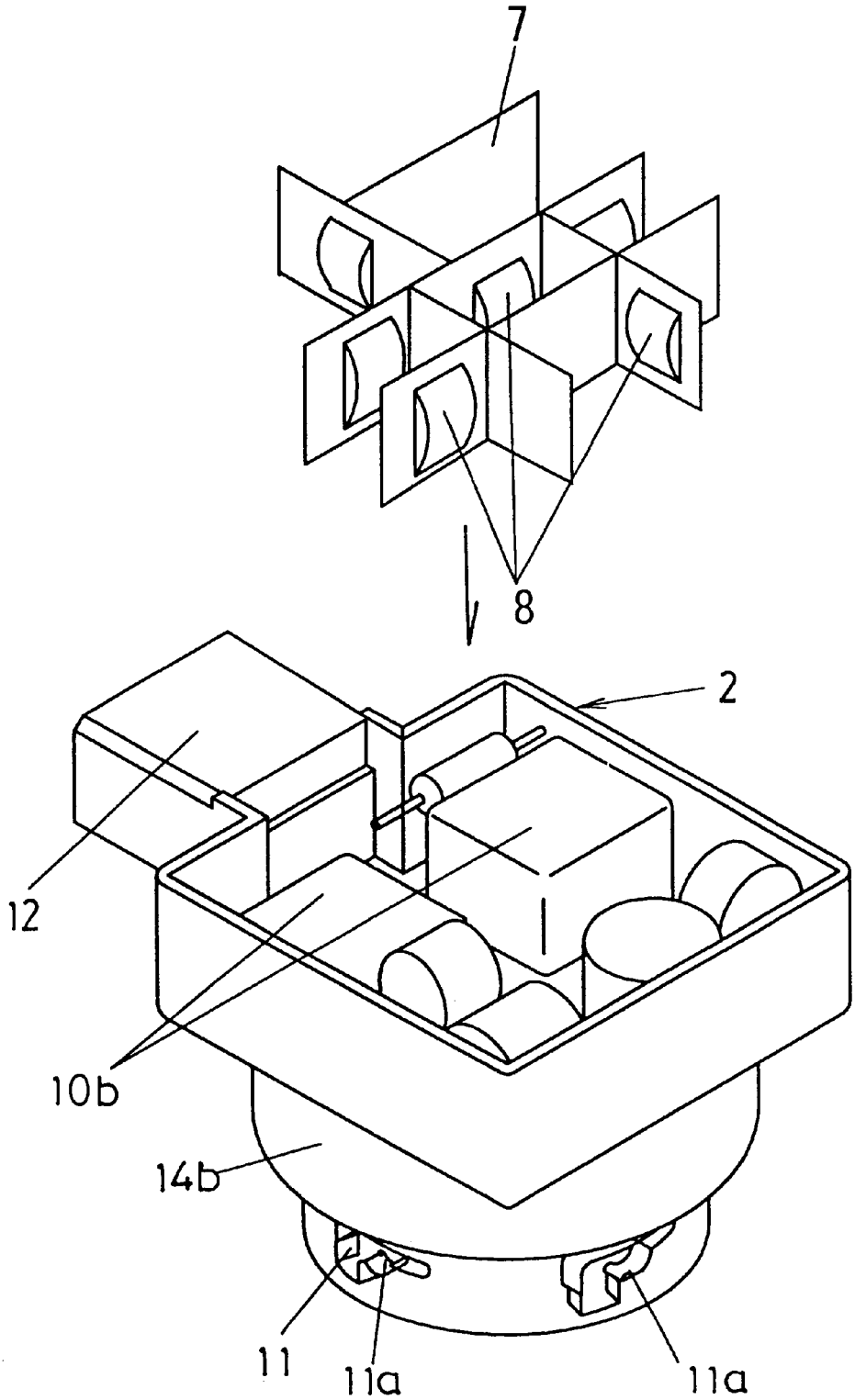
FIG. 21 is a perspective view as disassembled of the lamp socket in FIG. 20.
Figure 22:
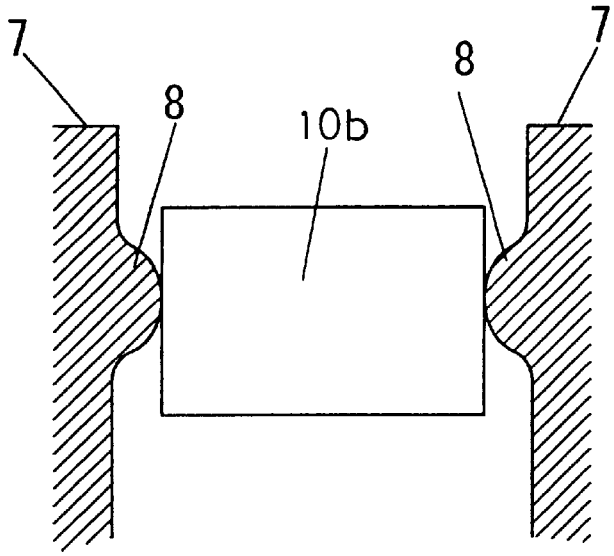
FIG. 22 is a fragmentary sectioned view as enlarged of the lamp socket in FIG. 20.

By the way, the terminals 10*c* of the electronic parts 10*b* generally have a plated layer formed on the surface of a copper made base, and such terminals 10*c* render the laser welding difficult. Accordingly, as shown in FIGS. 18 and 19, the lead frames 131 . . . are provided with through holes 13*c* for passing therethrough the terminals 10*c* of the electronic parts 10*b*, and the terminals 10*c* of the electronic parts 10*b* are connected at peripheral edge of the through holes 13*c*, whereby the laser welding is made possible only with respect to the plated layer on the surface of the terminals 10*c* even when the terminals 10*c* of the electronic parts 10*b* are copper-made, so that the connecting work between the lead frames 131 . . . and the electronic parts 10*b* can be made easier.

In FIGS. 20–31, there is shown another embodiment of the present invention. In this case, the socket body 2 of the lamp socket A comprises a resin molded article formed from a synthetic resin having insulating, properties and has the case 14 substantially of a box shape opened on one surface for housing the starting circuit section 10, and the transformer housing part 14*b* of a bottomed cylindrical shape is provided in the bottom part of the case 14. Further, the case 14 is provided, on one side face, with the cylindrical connector section 12 and, on the bottom face of the transformer housing part 14*b*, with the socket section 11 having fitting recesses 11*b* for inserting fittings 53 of the discharge lamp LA.

In the connector section 12, input terminals t11–t13 are respectively disposed to face an opening of the connector section 12 and, in the socket section 11, electrodes t21–t23 are respectively disposed in a state where their portions contacting with electrodes 55 and 56 of the discharge lamp LA are fitted in the fitting recesses 11*b*. Further in the socket section 11, a plurality of slits 11*a* opened on the side of open end of the socket section 11 are formed so that, when engaging pins 52 of the discharge lamp LA are placed at the positions of the slits 11a with the fittings 53 of the discharge lamp LA inserted in the fitting recesses 11b of the socket section 11 and the discharge lamp LA is rotated, the engaging pins 52 are engaged in the slits 11*a*, and the discharge lamp LA is held in the socket section 11. The arrangement is so made, at this point, that a central electrode 55 of the discharge lamp LA is electrically connected to the central electrode t21 of the socket section 11, and an outer peripheral electrode 56 of the discharge lamp LA is electrically connected to the outer peripheral electrode t22 and auxiliary electrode t23 of the socket section 11.

In the socket body 2, a holding member 7 disposed between such electronic parts 10*b* as igniter main circuit 32 and noise filter F for holding the respective electronic parts 10*b* is mounted dismountably. The holding member 7 is substantially lattice-shaped, and the electronic parts 10*b* are respectively disposed in each of zones partitioned in lattice shape. Projections 8 are provided on wall surface of the holding member 7 or on inner walls of the case 14 so that, when the electronic parts 10*b* are incorporated in the case 14, the projections 8 engage with surfaces of the electronic parts 10*b* so as to hold the electronic parts 10*b* so that, even upon application of vibration or shock to the socket section 11, any mechanical stress can be prevented from being applied to connecting portions between the electronic parts 10*b* and later described lead frames 13, and the reliability in respect of the electric connection is improved. In molding the respective electronic parts 10*b* with the filling material as the measure against the vibration, therefore, it is not required to fill the filling material inside the socket body 2 until the electronic parts 10*b* are all hidden, and it is possible to attain a cost reduction with the filling amount of the filling material reduced. Further, as the holding member 7 is formed with the synthetic resin of insulating properties, it is possible to insulate between the respective electronic parts 10*b* by enclosing the respective electronic parts 10*b* with the holding member 7.

Figure 28:
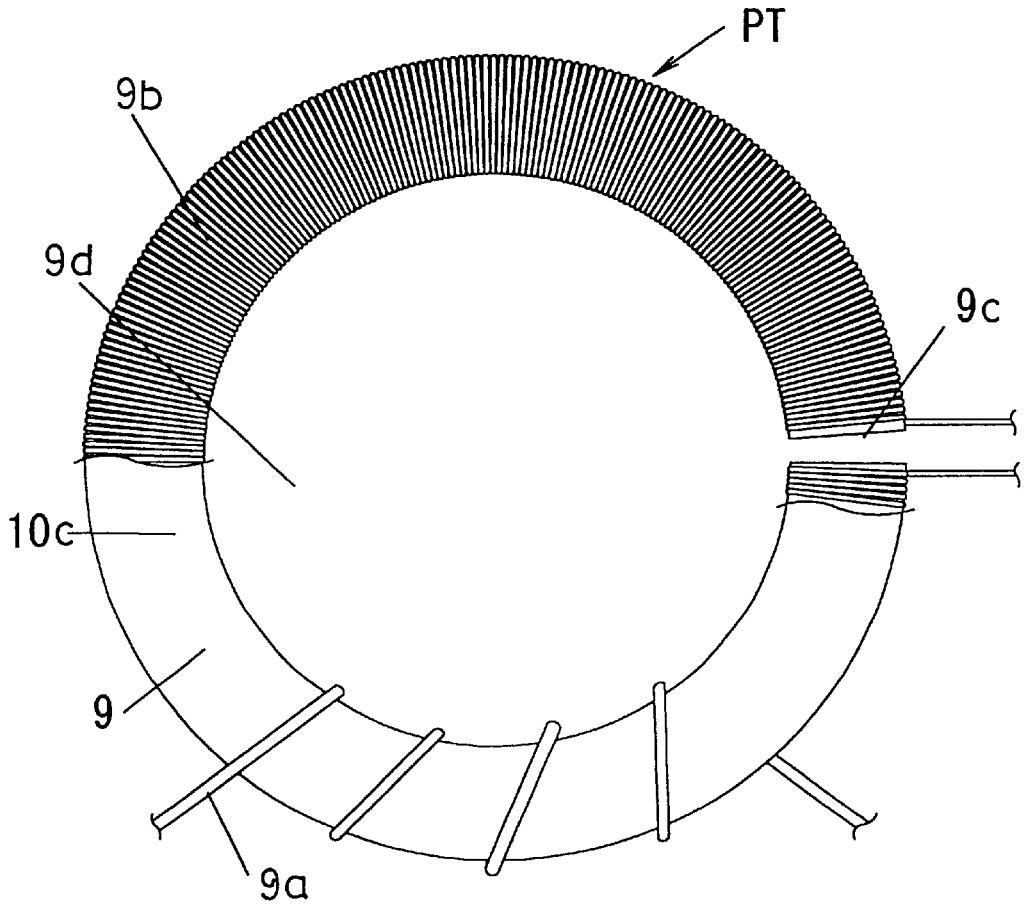
FIG. 28 is a front view of a pulse transformer employed in the lamp socket of FIG. 20 shown with part omitted.
Figure 29:
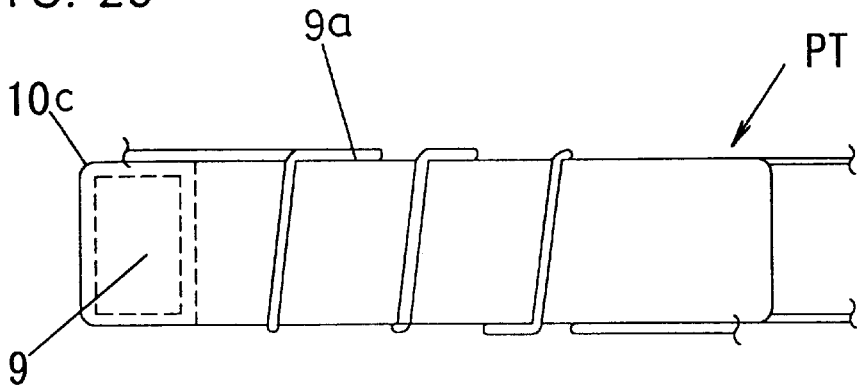
FIG. 29 is a sectioned view of the lamp socket in FIG. 20 shown with part omitted.

In the transformer housing section 14*b*, further, the pulse transformer PT is housed, and in the case 14 the electronic parts 10*b* of the igniter main circuit 32 are accommodated. The pulse transformer PT comprises, as shown in FIGS. 28 and 29, a core 9 formed substantially in C-shape with part of an annular magnetic material cut off, and is formed by covering the surface of the core 9 with an insulating tape 10*c* and winding over the insulating tape 10*c* the primary winding 9*a* by 5 turns, for example, and further thereover the secondary winding 9*b* by 160 turns, for example. As this pulse transformer PT comprises the core 9 insulated on the surface and the primary and secondary windings 9*a* and 9*b* wound on the core but is not provided with any coil bobbin, the pulse transformer PT can be dimensionally minimized by the volume of coil bobbin, and the dimensional minimization of the lamp socket A in the entirety can be attempted. By the way, both ends of the secondary winding 9*b* are led out of both sides of a cut-off part 9*c* of the core 9.

Figure 26:
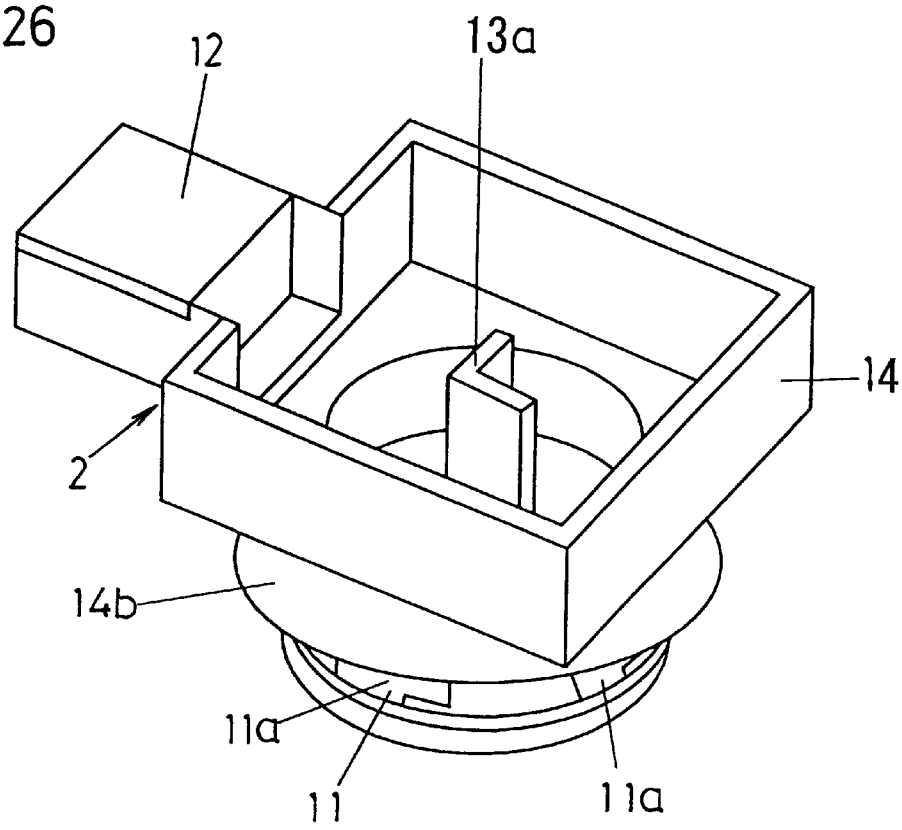
FIG. 26 is a perspective view of a socket body employed in the lamp socket of FIG. 20.
Figure 27:
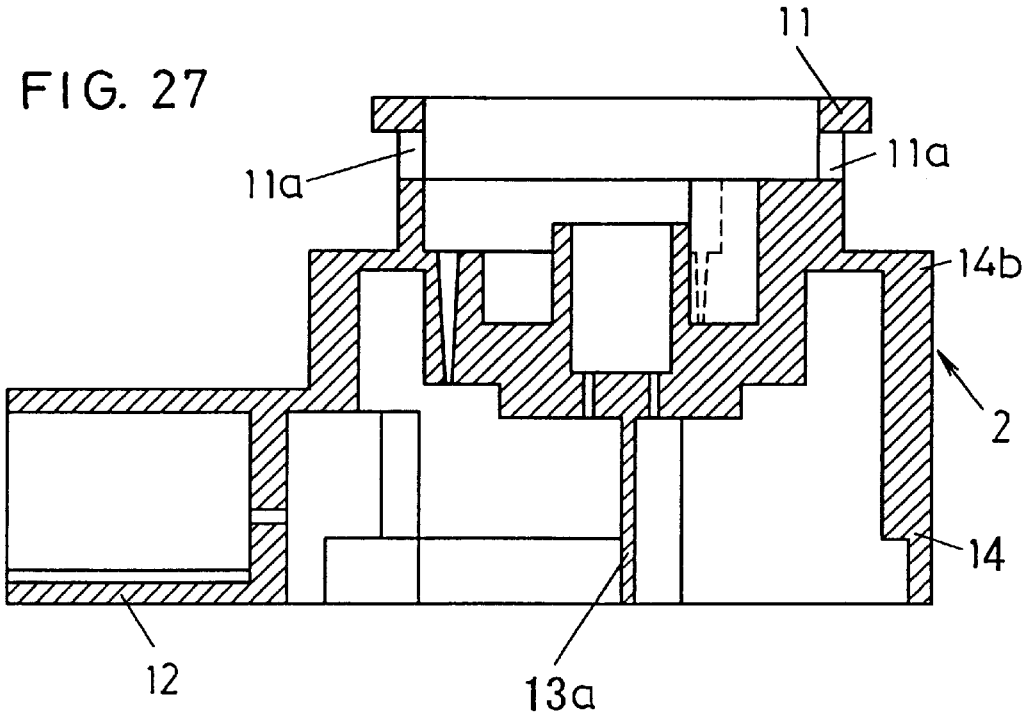
FIG. 27 is a sectioned view of the socket body employed in the lamp socket of FIG. 20.
Figure 30:
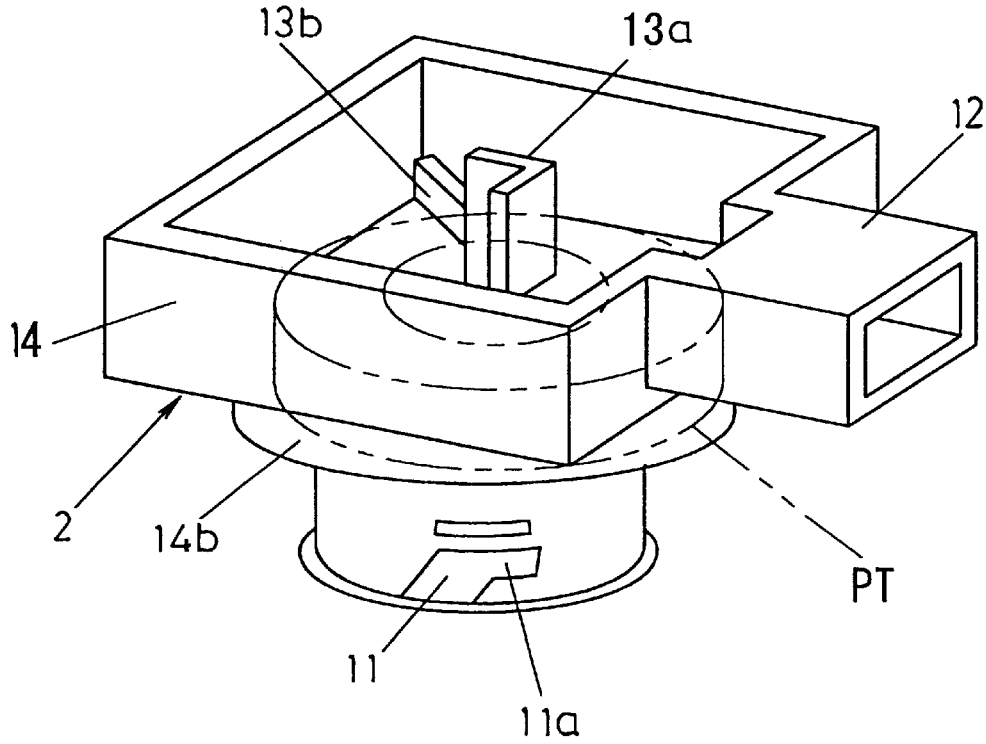
FIG. 30 is a perspective view of the lamp socket in FIG. 20 shown with part omitted.
Figure 31:
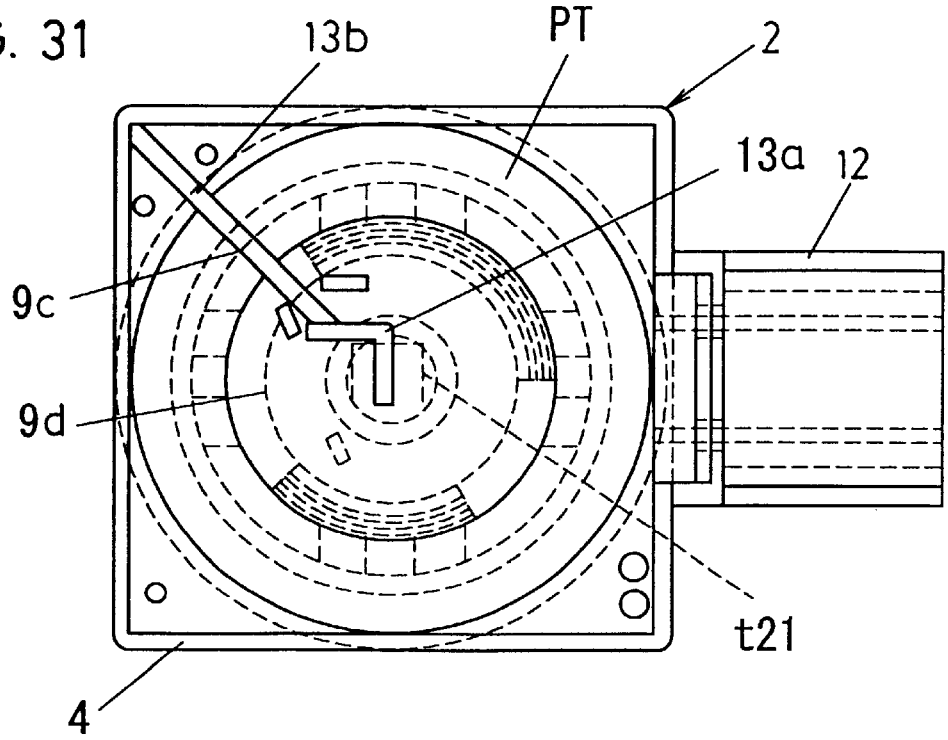
FIG. 31 is a plan view of the lamp socket in FIG. 20 shown with part omitted.

The pulse transformer PT is housed within the transformer housing section 14*b* such that a projecting end part of the central electrode t21 in the case 14 is passed through a bore 9*d* of the core 9. Here, as shown in FIGS. 26 and 27, the socket body 2 is provided with a projecting columnar insulating wall 13*a* covering around a position of the central electrode t21 which will project inside the case 14, and the insulating wall 13*a* covers around the central electrode t21, so that the insulation distance between the central electrode t21 and the electronic parts 10*b* of the igniter circuit 31 or of the noise filter F can be assured, and the socket body 2 is caused not to be dimensionally enlarged due to that the insulating distance is to be assured. As also shown in FIGS. 30 and 31, the socket body 2 is provided with a projecting rib 13*b* which is to be inserted in the cut-off part 9*c* of the core 9 so that, as the pulse transformer PT is incorporated into the transformer housing part 14, the rib 13*b* enters in the cut-off part 9*c*, and both ends of the secondary winding 9*b* (that is, a starting side end and a terminating side end of the secondary winding 9*b*) are mutually insulated by the rib 13*b*. While the high voltage is generated on the secondary side of the pulse transformer PT upon starting the discharge lamp LA, as has been described above, both ends of the secondary winding 9*b* are insulated by the rib 13*b*, and the socket body 2 is not dimensionally enlarged due to that the insulating distance between both ends of the secondary winding 9*b* is to be assured.

Figure 23:
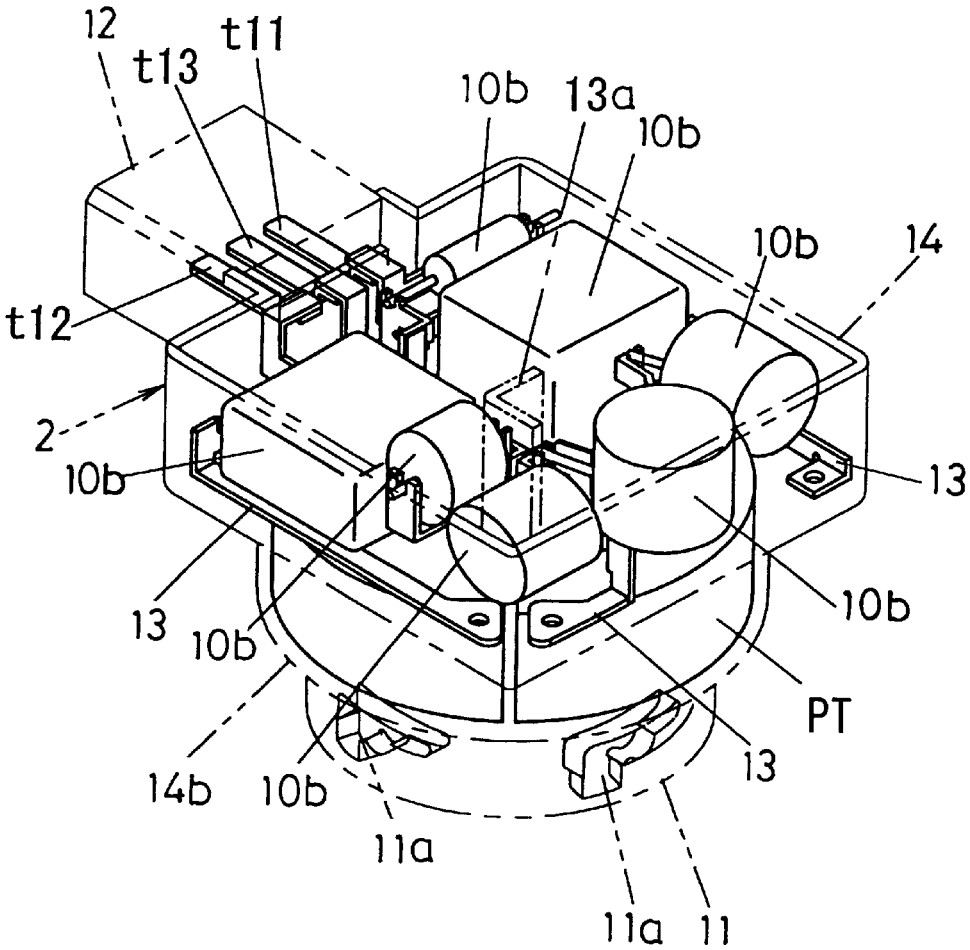
FIG. 23 is an explanatory view for a state of disposition of circuit parts of the lamp socket in FIG. 20.
Figure 24:
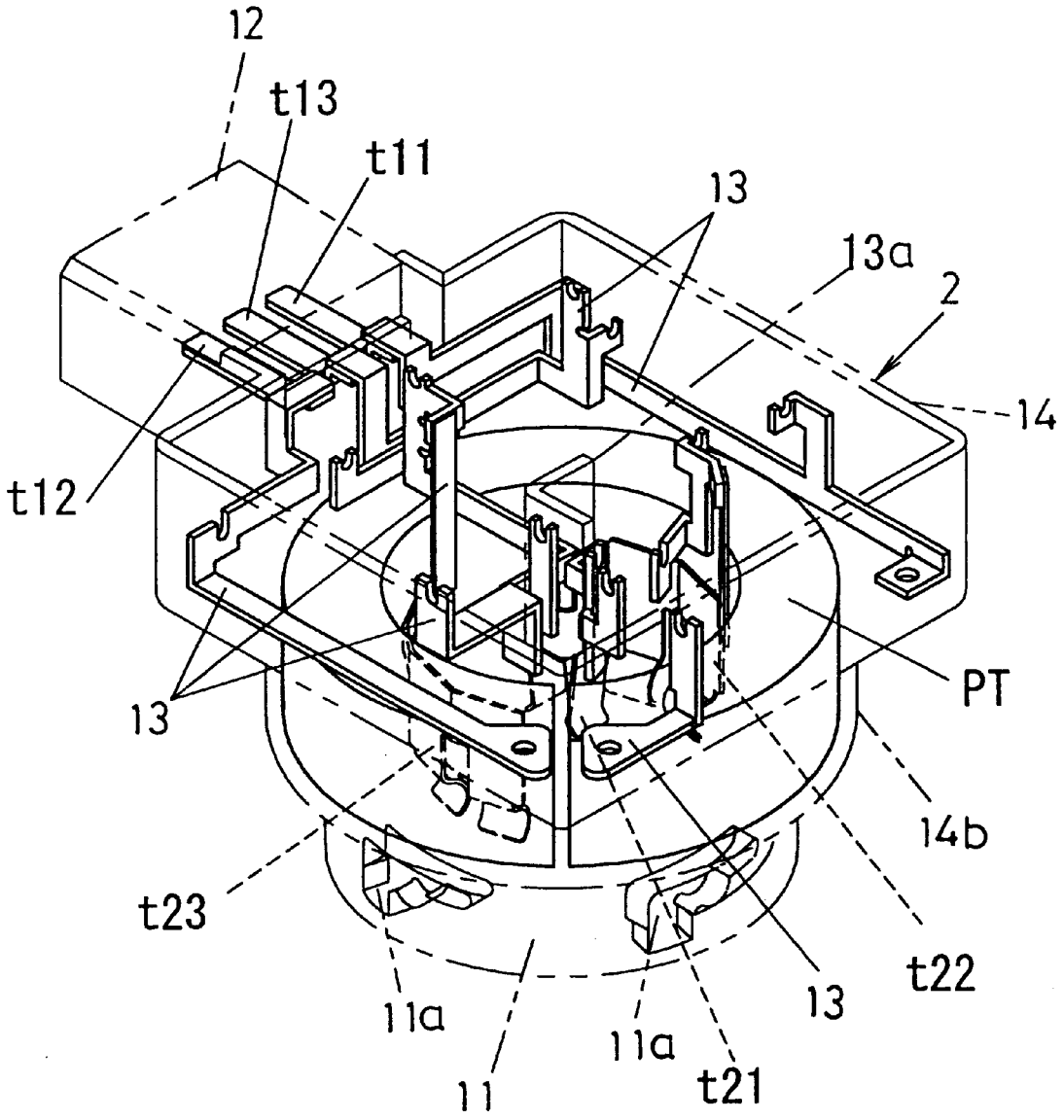
FIG. 24 is an explanatory view for a state of disposition of lead frames in the lamp socket of FIG. 20.
Figure 25:
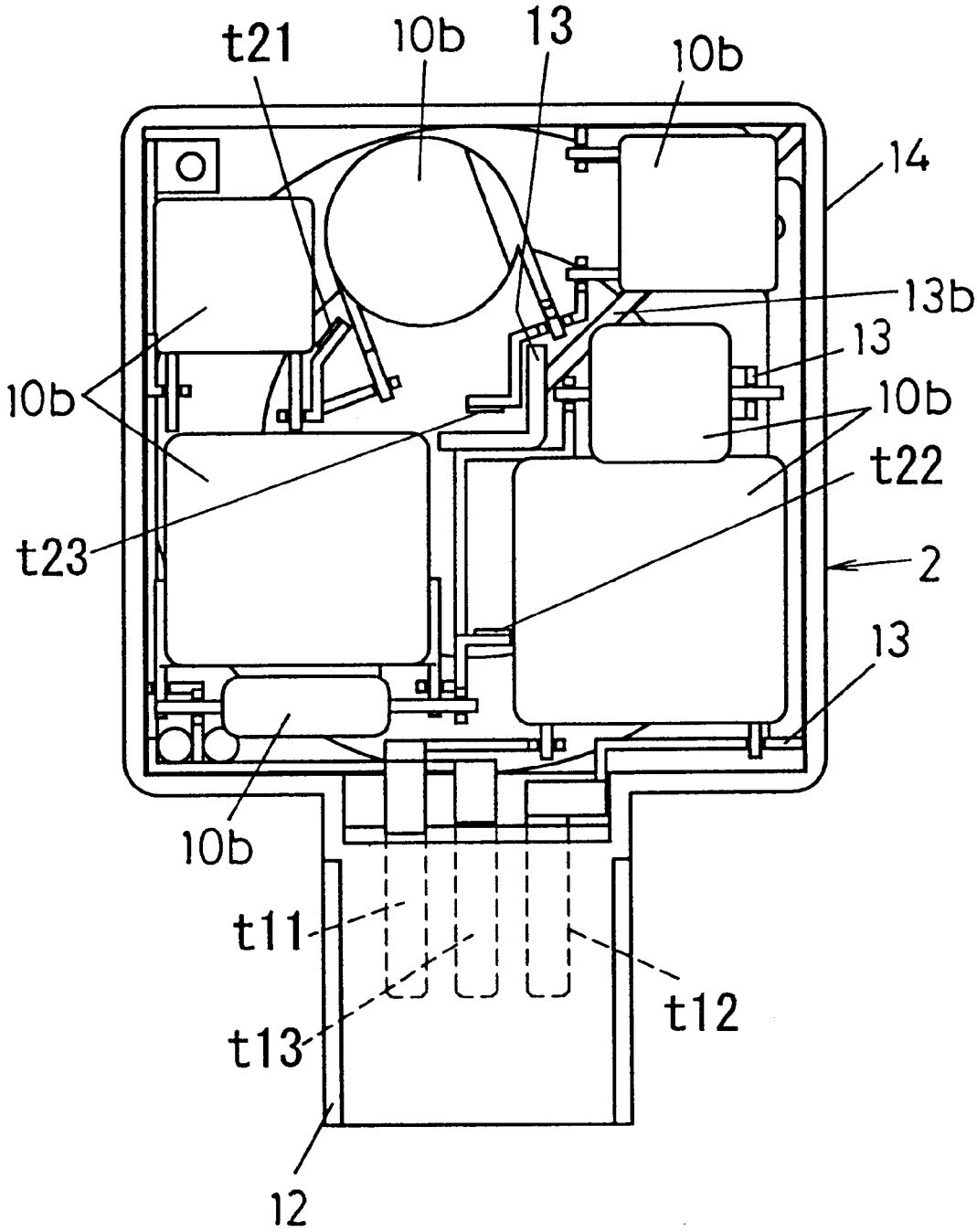
FIG. 25 is a plan view of the lamp socket of FIG. 20 shown with part omitted.

In the case 14 for housing the starting circuit, as shown in FIG. 23, the electronic parts 10*b* of the igniter circuit 31 and filter circuit F as well as a plurality of the lead frames 13 to be electrically connected to the input terminals t11–t13 or the respective lead frames 13 are accommodated. The lead frames 13 are to constitute electric paths of the interior circuits, and the interior circuits are formed, as shown in FIGS. 24 and 25, by connecting through, for example, the welding the electronic parts 10*b* of the igniter circuit 31 and noise filter F and the input terminals t11–t13 or the respective electrodes t21–t23. While in the present embodiment the lead frames 13 and the input terminals t11–t13 or the respective electrodes t21–t23 are formed separately and connected, it is also possible to form integrally the lead frames 14 and input terminals t11–t13 and respective electrodes t21–23 by means of a press working of a conducting plate metal. Further, the lead frames 13, input terminals t11–t13 and respective electrodes t21–t23 may be simultaneously molded with the socket body 2, and the respective electronic parts 10*b* and lead frames 13 may be connected after the simultaneous molding by means of the force inserting or fitting of the respective electronic parts 10*b* into the socket body 2.

What is claimed is:

1. A lamp socket comprising a socket section to which a discharge lamp is dismountably mounted, a connector section for electric connection to the exterior, a starting circuit section including a plurality of electronic parts and lead frames connected at least to part of the electronic parts to form wiring paths between the respective electronic parts for applying a high voltage to the discharge lamp to start the lamp, and a case in which the starting circuit section is provided, wherein the socket and connector sections are provided integral with the case.

2. The lamp socket according to claim 1 wherein the electronic parts constituting the starting circuit section include a transformer which applies a high voltage generated on secondary side of the transformer to the discharge lamp to start the lamp.

3. The lamp socket according to claim 1 wherein the socket and connector sections and the lead frames are integrally molded in the case made of a synthetic resin.

4. The lamp socket according to claim 1 wherein the socket section has a socket body to which the socket section for mounting the discharge lamp is provided, the connector section connects input wires from a lighting control circuit for controlling lighting state of the discharge lamp, the case accommodating the plurality of electronic parts of circuits including a starting circuit for applying to the discharge lamp the high voltage required for starting the discharge upon starting the discharge lamp is provided integrally with the socket body, and the case is provided with a hold member disposed between the plurality of electronic parts for holding the electronic parts.

5. The lamp socket according to claim 1 wherein the starting circuit section includes a high voltage pulse generating means for generating a high voltage pulse, a holding member is formed with an insulating material and provided to enclose at least the electronic parts to which the high voltage pulse is applied, and the holding member is provided with a partition for partitioning the case into a space for housing the high voltage pulse generating means and a space for housing other electronic parts than the high voltage pulse generating means.

6. The lamp socket according to claim 1 wherein connection between the electronic parts of the starting circuit section and the lead frames, mutual lead frames and mutual electronic parts is made by means of a laser welding, spot welding, resistance welding or soldering.

7. The lamp socket according to claim 1 wherein a holding member is formed to be integral with at least one of the case, connector section and socket body.

8. The lamp socket according to claim 1 characterized in that the socket and connector sections formed separately from the case are joined with the case by means of a welding employing vibration and ultrasonic.

9. The lamp socket according to claim 1 which further comprises a conducting member covering substantially the entirety of the socket section, connector section and case.

10. The lamp socket according to claim 1 wherein the socket section is formed in a cylindrical shape fitting to a lamp base of the discharge lamp, peripheral part of which section is provided with insert grooves for inserting therein engaging projections projecting from peripheral part of the lamp base, engaging grooves communicating with the insert grooves for allowing the engaging projections to engage therein as the discharge lamp is rotated, and slits parallel to the engaging grooves.

11. The lamp socket according to claim 1 wherein the starting circuit section has a pulse transformer which generates a high voltage pulse, the pulse transformer being constituted by a core formed to have a part cut off to be C-shaped and having primary and secondary windings wound thereon, and the case being provided with an insulating wall inserted in the cut-off part of the core.

12. The lamp socket according to claim 4 wherein the lead frames are provided with through holes for passing leads of the electronic parts, the leads of the electronic parts and lead frames being connected at peripheral edges of the through holes.

13. A discharge lamp lighting device comprising a lighting circuit section for supplying a power to a discharge lamp with a source power received from a power source, a starting circuit section which comprises a plurality of electronic parts including a transformer and lead frames connected at least to part of these electronic parts for starting the discharge lamp with application to the lamp of a high voltage caused to be generated on secondary side of the transformer, a connector section for connecting between the lighting circuit section and the starting circuit section, a socket section to which the discharge lamp is dismountably mounted, and a lamp socket housing therein the starting circuit section and having a case provided integral with the socket and connector sections, the socket including a socket body provided with the socket section to which the discharge lamp is mounted, the connector section having as connected thereto an input line from a lighting control circuit for controlling lighting state of the discharge lamp, the socket body being provided integrally with the case housing the plurality of electronic parts of the circuits including a starting circuit applying to the discharge lamp a required high voltage pulse for starting a discharge in starting the discharge lamp, the case being provided with a holding member disposed between the plurality of the electronic parts for holding the electronic parts, the starting circuit including means for generating the high voltage pulse, the holding member being formed to enclose the electronic parts to which the high voltage pulse is applied, the holding member being provided with a partition for partitioning the case into a space for housing the high voltage pulse generating means and a space for housing other electronic parts than the high voltage generating means, the holding member being formed integral with at least one of the case, connector section and socket body, the starting circuit including the transformer which generates the high voltage pulse, the transformer being constituted by a core formed in a C-shape with part cut off and primary and secondary windings wound on the core, and the case being provided with an insulating wall which is inserted in the cut off part of the core.

* * * * *